United States Patent [19]

Walter et al.

[11] 4,394,408

[45] Jul. 19, 1983

[54] APPARATUS AND METHOD FOR APPLYING ADHESIVE TO A CONTAINER EDGE PORTION

[75] Inventors: John Walter, Evergreen Park, Ill.; Donald J. Roth, Westport, Conn.; Charles S. Kubis, Willowbrook, Ill.

[73] Assignee: The Continental Group, Inc., Stamford, Conn.

[21] Appl. No.: 355,500

[22] Filed: Mar. 8, 1982

[51] Int. Cl.[3] ..... B05C 3/20; B05C 7/00; B05D 3/12; B05D 7/22

[52] U.S. Cl. ..... 427/231; 118/56; 118/102; 118/105; 118/107; 118/416; 118/620; 427/46; 427/232; 427/234

[58] Field of Search ..... 118/56, 102, 105, 107, 118/620, 416; 427/231, 232, 234, 46

[56] References Cited

U.S. PATENT DOCUMENTS 4,235,187 11/1980 Mirza ..... 118/56 X

*Primary Examiner*—James R. Hoffman

*Attorney, Agent, or Firm*—Charles E. Brown

[57] ABSTRACT

An apparatus and method for applying an adhesive to the edge of the can by inserting the can into the adhesive to its top surface and rotating the can 360° or more, then past the edge of a doctor roll to remove excess adhesive in a selected region and then advancing the cans through an induction heater in a continuous motion until the can reaches a discharge station where it is released.

13 Claims, 8 Drawing Figures

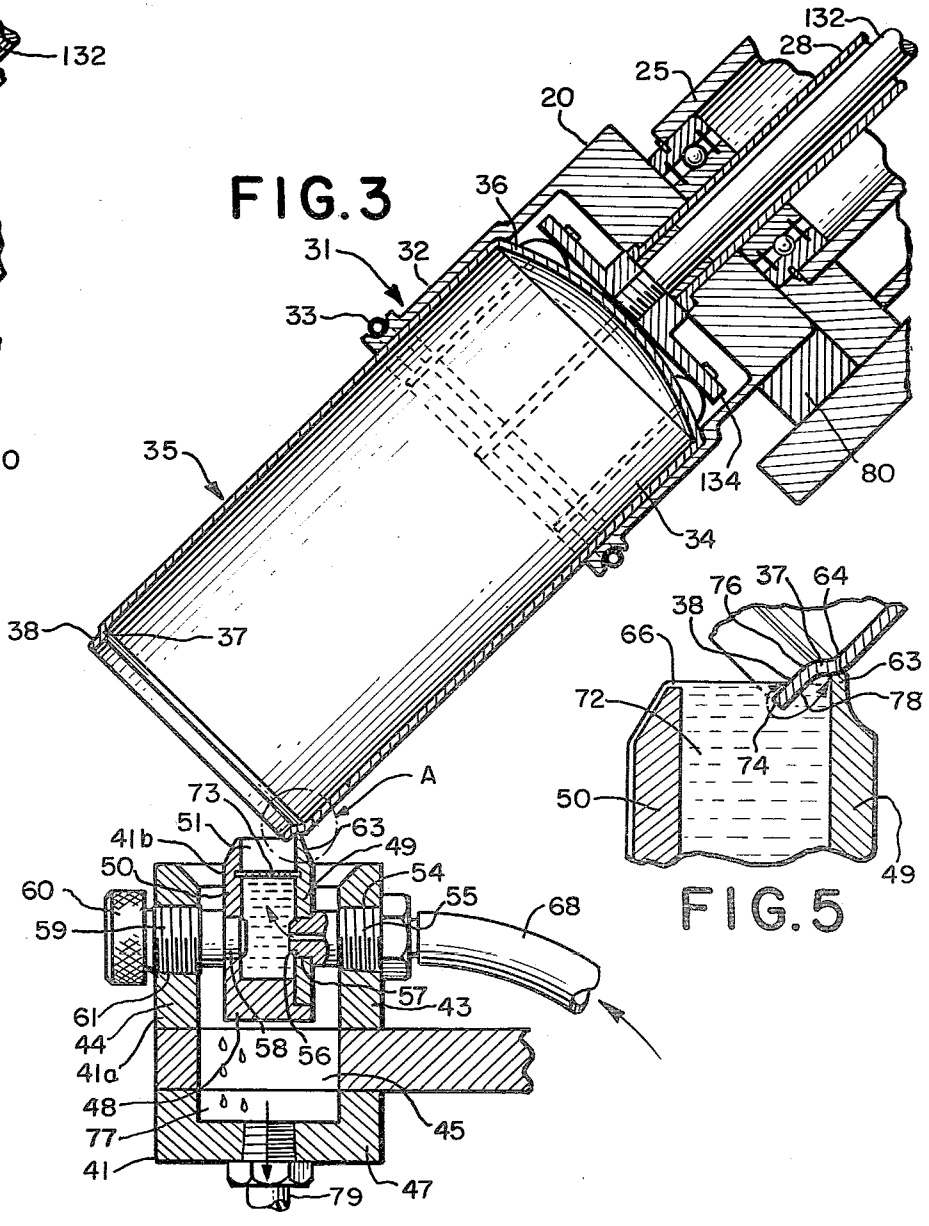
FIG. 3
FIG. 5
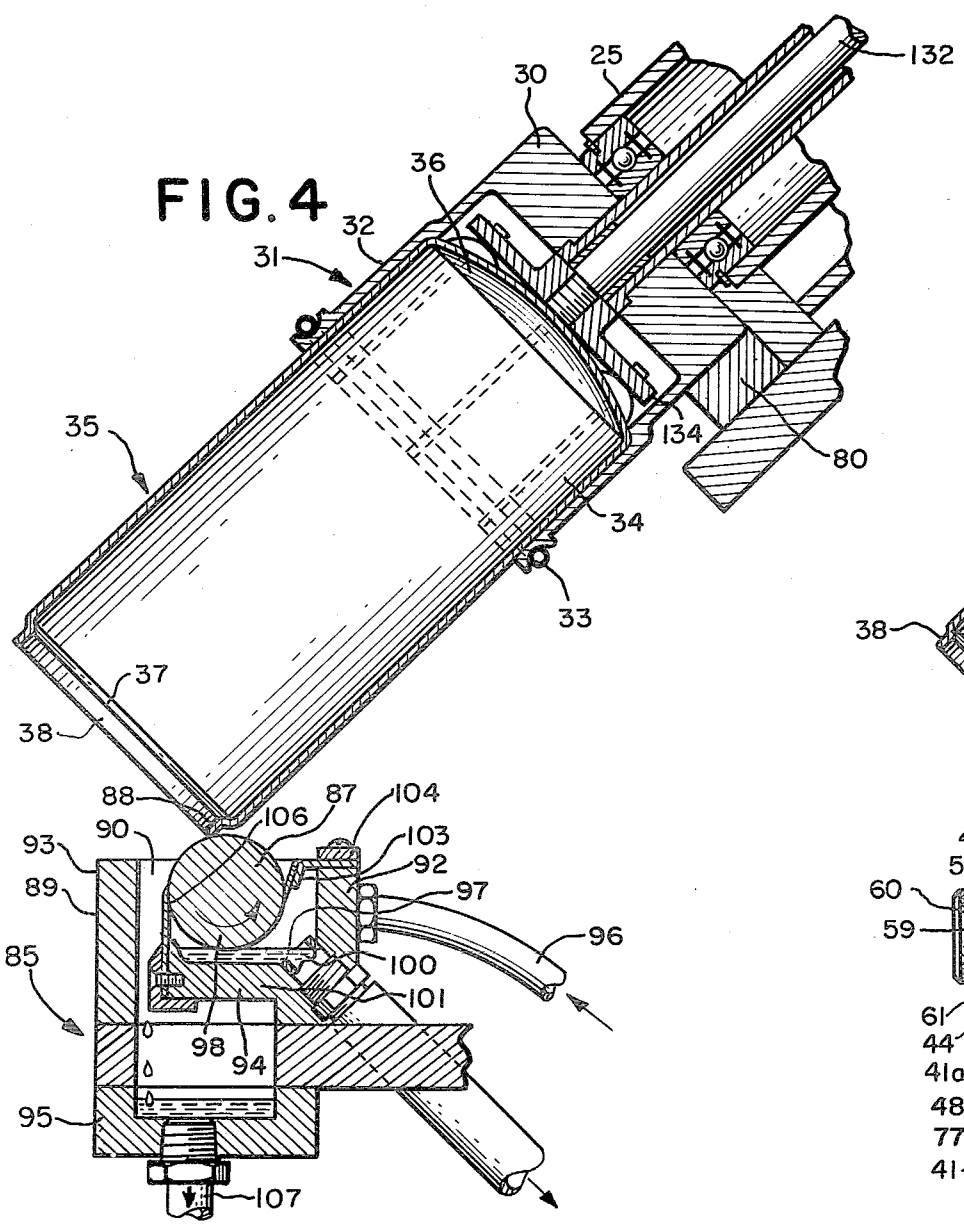
FIG. 4

APPARATUS AND METHOD FOR APPLYING ADHESIVE TO A CONTAINER EDGE PORTION

BACKGROUND OF THE INVENTION

There is presently being developed a new container comprising a bottom member having a cylindrical body and an integral bottom. The body is open at the top which is defined by a free upper edge portion. A top member is fitted over the free edge portion and is bonded thereto by adhesive. The adhesive, which is a thermoplastic material, is thermally cured to bond the top and bottom members into a unitary structure.

SUMMARY OF THE INVENTION

Consideration had been given to brush application of a band of adhesive to the free edge portion. Nozzle application also was considered as well as dipping of the entire can edge into a batch of adhesive. All of these systems were found wanting either because of unsatisfactory application or as being too slow for high speed manufacture. The nozzle application requires rigid controls and constant cleaning to prevent the nozzle from fouling and smearing. Excessive loss of adhesive may also occur.

The typical dip method relies upon the viscosity and other characteristics of the adhesive to adhere and to migrate uniformly about the entire surface to be covered. Upon withdrawal of the container after dipping from the adhesive filamentary fibers of adhesive are drawn out of the adhesive holding tank attached to the can edge. The presence of these thread-like filaments of adhesive hanging from the container is undesirable. They accrete on other components of the machine and when the can would be inverted to an upright position, could fall onto the imprinting surfaces of the can body and affect the quality of the printing.

A general object of the invention is to provide a novel adhesive applicator apparatus for cans and the like.

A further object is to provide an applicator in which the can is caused to roll along a cut-off edge of an adhesive-containing trough in dipping relation to the adhesive to apply a consistent quantity of adhesive to the can edge portion at which it is to be bonded to an associated second part of a can.

A further object is to provide a novel mechanism for removing excess adhesive in undesired locations.

Another object is to provide a novel curing means for the adhesive arranged to operate along the orbital path of the cans after adhesive application.

Another object is to provide a novel apparatus including a support for the can orbiting apparatus which may be easily positioned to obtain proper positioning of the cans with the adhesive applicator and also other components of the apparatus.

Another object is to provide a novel mechanism for applying the adhesive to the container edge portion with a novel combination dipping and rolling method.

The invention further comprehends providing novel apparatus which, immediately after adhesive application to the container and while the containers are being carried by the same conveying system which moves the containers through the adhesive application stage, the containers are moved along a heating zone provided by induction coils for curing the adhesive.

Another object is to provide a mechanism in the form of a doctor roll for wiping off excess adhesive from the free edge of the container to prevent the formation of beads which would interfere with the proper assembly of the can tops with the bottom portion.

These and other objects and advantages inherent in and encompassed by the invention will become more apparent from the specification and the drawings, wherein:

FIG. 3 is a cross-sectional view on an enlarged scale taken on line 3—3 of FIG. 2;

FIG. 4 is an enlarged cross-sectional view taken substantially on line 4—4 of FIG. 1;

FIG. 5 is an enlarged portion of FIG. 3 shown in the circle labeled "A" in FIG. 3 illustrating the adhesive trough and position of the container edge in its passage through the adhesive application station.

DESCRIPTION OF THE INVENTION

Figure 1:
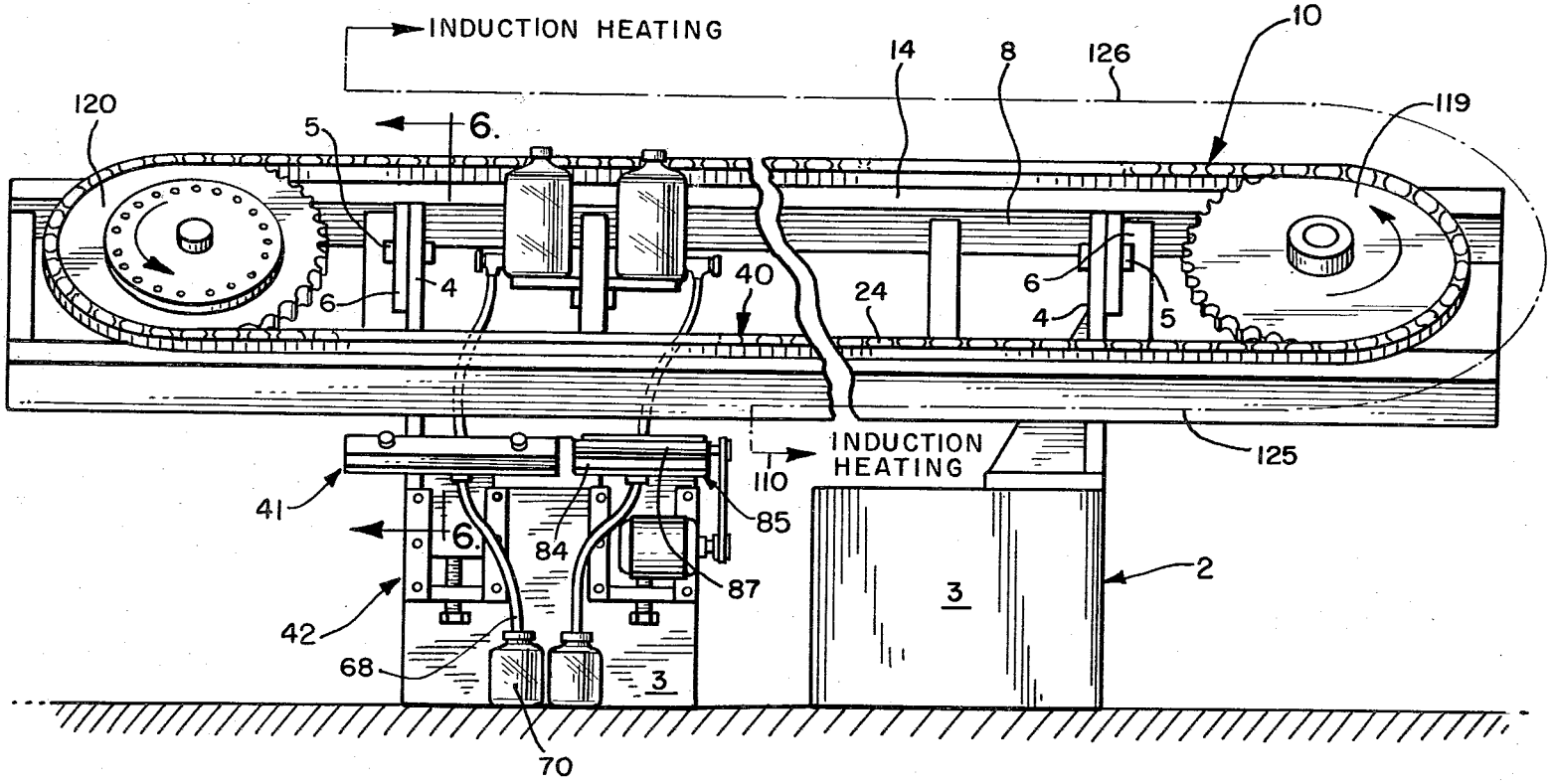
FIG. 1 is a side elevational view of the novel apparatus, parts being removed and parts diagronatically shown.

The adhesive applicator and curing apparatus generally designated 2 in the drawings comprises a base support 3 which carries upright standards 4,4. The standards 4,4 are pivotally connected by means of coaxial horizontal shafts 5,5 to laterally spaced frame members 6,6 of a conveyor framework 8 of a conveyor generally designated 10.

Figure 6:
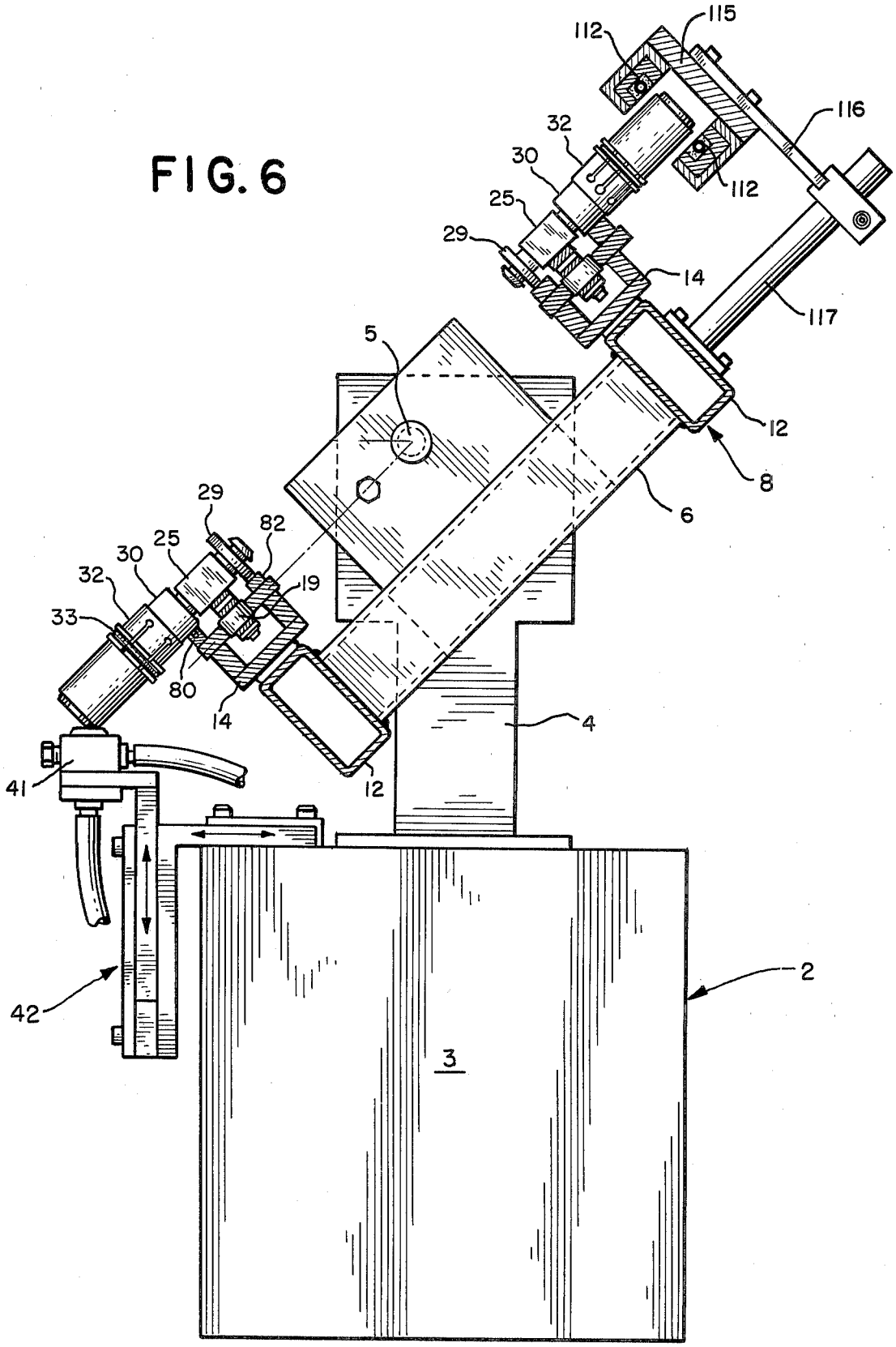
FIG. 6 is an enlarged cross-sectional view taken substantially on line 6—6 of FIG. 1.
Figure 8:
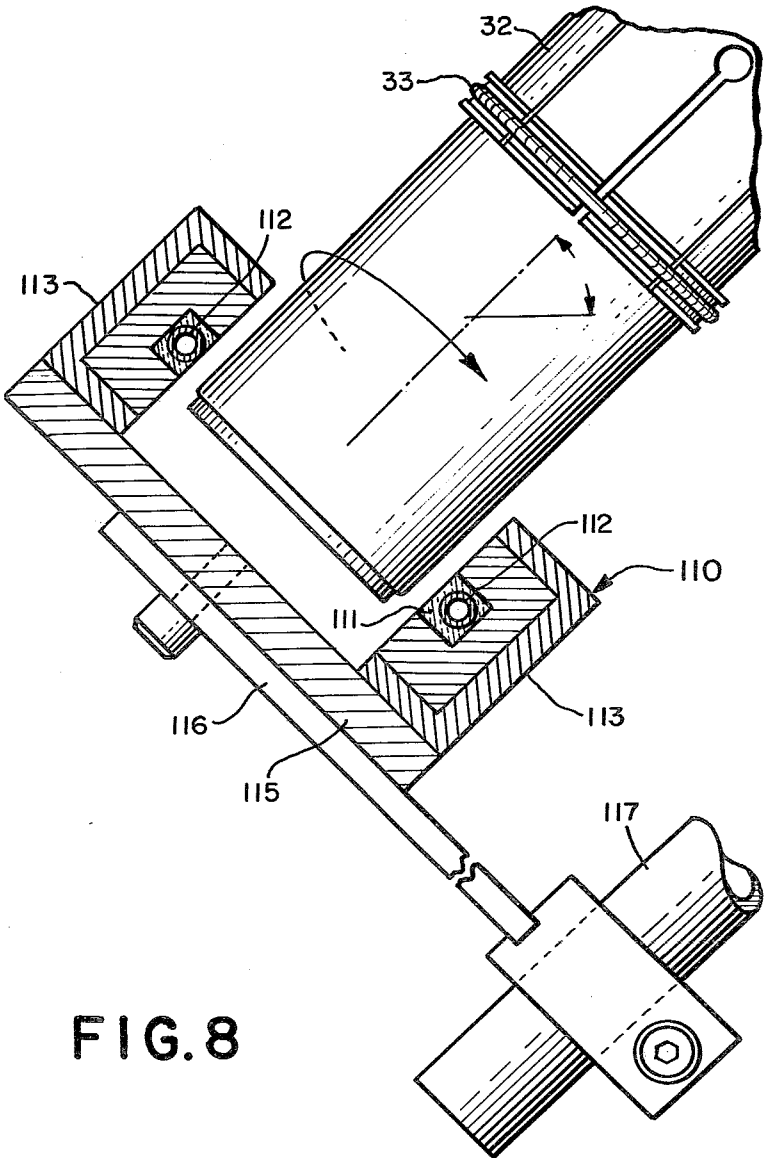
FIG. 8 is an enlarged section taken substantially on line 8—8 of FIG. 1.
Figure 7:
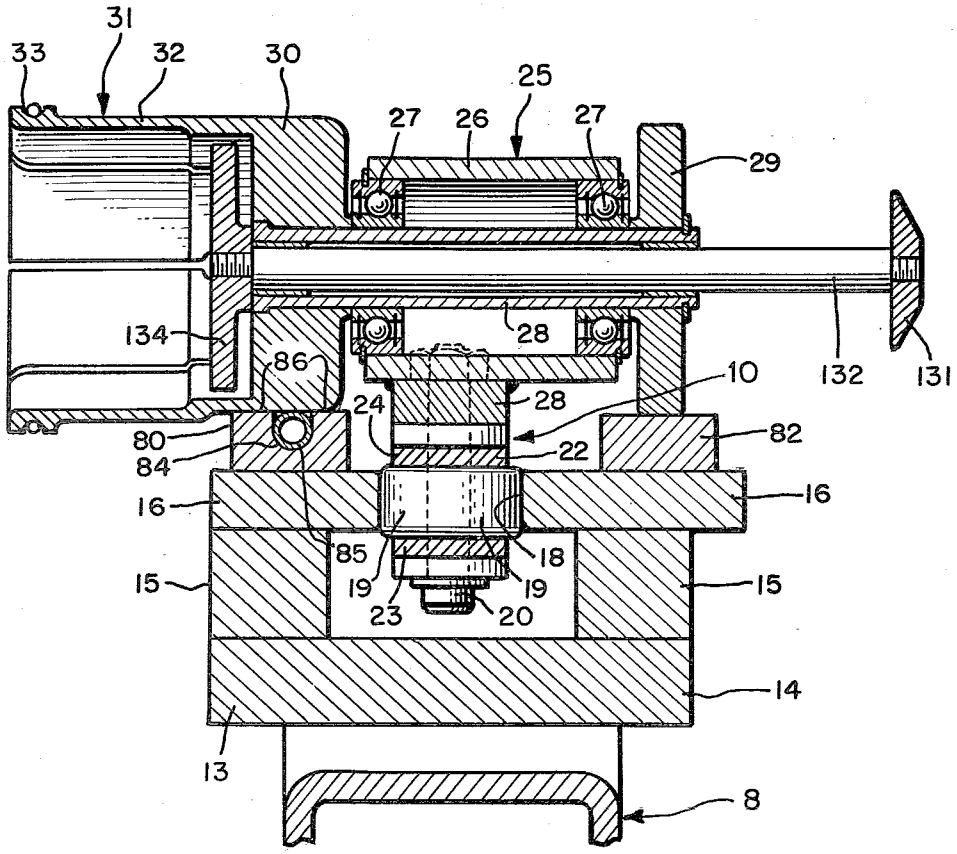
FIG. 7 is an enlarged sectional view taken substantially on line 7—7 of FIG. 2, the can being removed.

The framework 8 in addition to the intermediate beam members 6,6, comprises longitudinal box-shaped beams 12,12 (FIG. 6), connected to the members 6.

The beam members 10,10 support an endless U-shaped track 14 which has a bottom wall upright at legs 15,15 which are connected to guides 16,16.

The guides 16,16 define a guide slot 18 therebetween receiving a guide roller 19 fixed to the lower end journaled on a mounting pin 20 which is connected to upper and lower links 22,23 of the conveyor chain 24.

At periodic intervals there are connected to the upper or top links 22 roller mounts 25, each comprising a cylindrical housing 26 with bearings 27 supporting a tube 28 which at its ends is press fitted or otherwise connected with drive rollers 29,30 positioned at opposite ends of housing 28. The roller 30 forms the base of a can carrier comprising a collet 32 which is an axially slotted cylindrical cup-shaped structure with a band 33 of elastomeric material sleeved thereover to releasably hold sections 31 of the collet about the lower end portion of a body 34 of a can 35 therein.

The can body 34 has a bottom 36 at one end and a necked-in free edge section including a frusto-conical portion 37 and a cylindrical band portion 38.

Figure 2:
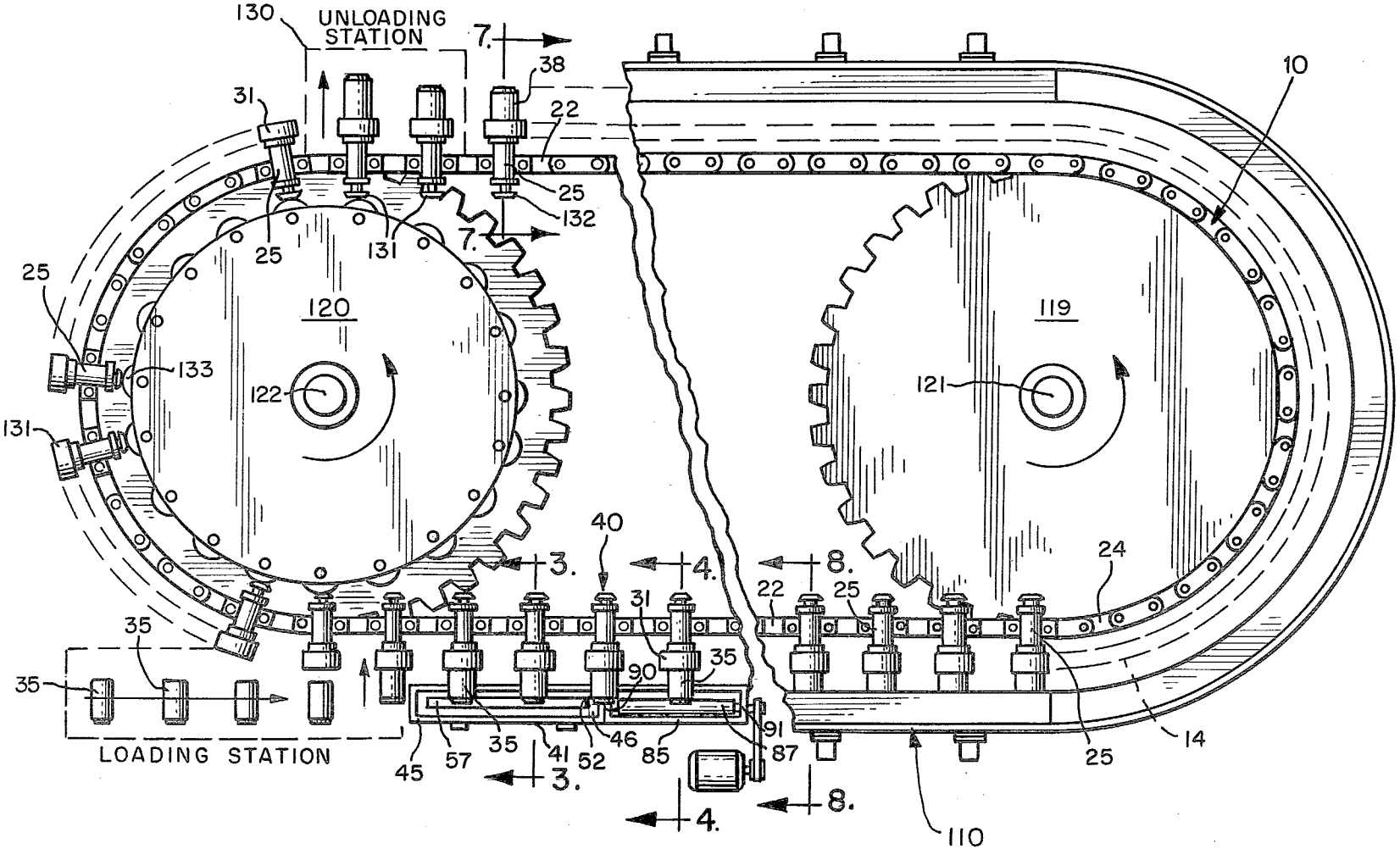
FIG. 2 is an enlarged broken side view of the applicator apparatus.

As best seen in FIG. 2, a row of cans 35 are delivered by a loading mechanism of any well-known design such as a conveyor with cups (not shown) holding the separate cans and advancing in synchronism with the can carrier 31 so that as the collets align with the respective cans they are then inserted therein.

The conveying system 10 is advanced along its run 40 with the cans positioned in a diagonally downward attitude toward a trough assembly 41 of an adhesive application station 42 as seen in FIG. 3. The trough assembly 41 may be adjustably mounted on the base 3 shown by the arrows in FIG. 6 and comprises a rectangular container 41*a* elongated generally parallel with the advance run 40 and comprises intermediate upright side walls 43,44 and end walls 45,46 and a bottom wall 47. The assembly 41 comprises an inner rectangular trough 41*b* having a bottom wall 48, side walls 49,50 and end walls 51,52. Container 41*a* is provided through its wall 43 with a threaded opening 54 into which there is threaded an inlet nozzle 55 which has a reduced tip 56 which has a seal tight fit within a port 57 in the side wall 49 of trough 41*b*. The opposed side wall 50 of the trough 41*b* has an aperture into which there is extended a reduced cylindrical pilot end 58 on the shank 59 of a retaining screw 60, the shank being threaded through a threaded aperture 61 in side wall 44 of container 41*a*. As best seen in FIG. 5, the wall 49 is in the nature of a mask blade having a thin upper masking edge 63 with a sharp interior corner 64. The wall 50 of the trough has an upper edge 66 slightly lower than edge 63 and at its exterior side provides an overflow groove for the plasticized adhesive which is delivered into the trough 41*b* through the nozzle 55 from a conduit 68 which is connected to a supply reservoir 70. The nozzle screw arrangement 55, several of which may be provided along the length of the trough, provide means of lateral adjustment of the trough. The masking blade edge is elevated above the top of the trough so that the free edge section of each can is caused to advance onto the blade edge 63 and the frusto-conical portion 3 is caused to ride on the corner 64 while the band portion 38 is immersed into the adhesive 72 which is elevated through a diffusion plate 73 and spills over the top edge 66 of the side wall 50 to the sump 77 into a drain hose 79. The adhesive covers not only the extremity 74 of the band 38 but also its inner side 76 and outer side 78.

The rolling action of the can is caused by the base roller 30 and roller 29 rolling upon tracks 80 and 82 which are mounted on and fastened to the chain roller guides 16,16 of the track.

In order to provide more positive traction for roller 30, the upper side of the rail or track 80 upon which it rides is provided with a U-shaped slot 84 within which there is positioned a pressurized elastomer tubing 85 which in expanded condition extends slightly above the traction surfaces 86,86 of the rail 80 and in being flattened provides a surface of high coefficient of friction to insure rolling of the cans attendant to the conveyor chain being pulled by associated mechanism hereinafter to be described.

As best seen in FIGS. 1, 2 and 4, each can is moved into a wiper roll station 85 over motor driven wiper or doctor roller 87 in wiping contact with a corner 88 of the band 38 of the edge portion of the can to remove any beads of adhesive which may accumulate thereon upon removal from the adhesive applicator station. The roller 87 is positioned transversely of the can generally parallel to its travel path in that section of its orbit and extends above the upper edge or brim of the container 89 in which it is mounted. The roller is journaled in end walls 90,91 parallel with side walls 92,93 of a combination solvent trough 94 and drain tank 95 therebelow. Solvent conduit 96 extending from container 96 is connected through wall 92 to the solvent trough 94 for introducing solvent 97 into the trough 94 in which the lower portion 98 of the roller bathes. The level of the solvent is maintained by a spill-over drain 100 which is in the form of a nipple threaded into an aperture in the bottom wall 101 of the solvent trough. A solvent wiper blade 103 is secured to wall 92 by a clamp 104. The blade 103 has a plastic polyethylene metal-backed wiper in wiping contact with the upside sweep of roller 87.

The downside sweep of the roller 87 is in contact with a a wiper blade 105 which may also be a metal-backed polyethylene strip held to wall 106 of the solvent trough. Wall 106 is spaced from wall 93 of the solvent drain tank so that the adhesive scraped off by the blade 105 will drop to the bottom of the tank and exit through a drain hose 107 as shown.

After the passing over the wiper roll the rotating cans, with the proper amount of adhesive thereon, enter into a heating station 110 which comprises a pair of induction coil tubes 112 suitably water-cooled and insulated in a woven fiberglass tube 111 and potted or mounted within housings 113,113 defining a guideway 114 for the free ends of the cans. The housings 113 are mounted on a base plate 115 which is secured at spaced intervals to support brackets 116 carried on support arms 117 suitably mounted on the conveyor frame.

It will be noted from FIGS. 1 and 2 that the conveyor chain is trained about two sprockets 119,120 which rotate about parallel axes defined by shafts 121,122 suitably supported by the associated framework. Shaft 122 is preferably keyed to sprocket 120 and is driven by a suitable motor (not shown) in well known manner.

The induction coil has a leg portion 125 downstream of the solvent tank and loops about the sprocket 119 and has its other leg 126 extending the major length of the downstream estent of the return run of the conveyor chain and terminates proximate to the unloading mechanism diagrammatically shown at 130 which may be any form of collection station well known in the art. At the unloading mechanism the cans are ejected from the respective collets by having the strikers 131 of the ejector spindles 132 sequentially engage cans 133 mounted for rotation with the sprocket 120, the cans urging the ejector spindles radially outwardly and thus the pusher disk 134 connected thereto to force the can out of the respective collet. The empty collet assemblies are then returned about the sprocket 120 to the loading mechanism and the process repeats in the orbit.

A preferred embodiment of the invention has been disclosed. It will be apparent that various modification may be made which come within the scope of the approved claims.

What is claimed is:

1. Apparatus for applying adhesive to the free edge of an open ended can comprising:

means for moving and rotating the can in a predetermined path;

an adhesive dip tank disposed along said path containing adhesive having a top surface, and means for holding the can at an acute angle to the said top surface of the adhesive and immersing a section of the edge of the can into the adhesive while said can is rotated and moved in said path.

2. Apparatus according to claim 1 and means for controlling the flow of said adhesive on said can edge to a predetermined area.

3. The invention according to claim 2 and said controlling means comprising a masking blade projecting above the level of the adhesive and having a cut-off edge in relative rolling contact with a can passing thereabove.

4. The invention according to claim 1 and doctor means positioned in said path for wiping contact with the extremity of said free edge for removing excess adhesive from said extremity.

5. The invention according to claim 4 and said doctor means comprising a solvent carrying roller having a cylindrical periphery.

6. The invention according to claim 4 and induction heating means mounted in flanking relation to the path of said cans for curing the adhesive.

7. Apparatus for applying adhesive to the open edge portion of a can comprising an endless conveying means, can holding means thereon for holding a can, an adhesive applicator comprising a trough with adhesive therein, said can being positioned to dip into said adhesive at an acute angle to the top surface of the adhesive with a small section of said edge and thereafter said can being rotated and simultaneously moved laterally while dipped in said adhesive to cover the entire circumferential extent of said edge.

8. A doctor assembly for removing excess adhesive which had been applied to the free edge of a can comprising a trough, a roller rotatable therein and having a section extending above said trough, and means for relatively positioning said roller and can in tangential arrangement for wiping engagement by the roller.

9. The invention according to claim 8 and said can and roller being disposed with their axes in intersection relation.

10. A method of applying an adhesive to a can having a free edge to cover the interior and exterior sides of said edge and the extremity thereof comprising providing a vessel with plasticized adhesive, mechanically positioning the can with its free edge at an acute angle to the top surface of the adhesive and inserting only a section of the edge into the adhesive sufficient to cover the inner and outer sides of said edge and extremity, then mechanically rotating the can and laterally moving the can while immersed in the adhesive to cover the entire periphery of said edge, then withdrawing the can.

11. The invention according to claim 10 and while rotating the can mechanically holding it against a guide and dam blade to demark the limit of flow of the adhesive axially of the can and the area of adhesive application.

12. In an apparatus including a series of operating stations including one for applying adhesive to an edge portion of a can, said apparatus comprising:

an endless carrier having holders for releasably holding individual cans and moving said cans in a predetermined path through said series of stations from a loading station to an unloading station, and induction heating means comprising means providing a way in alignment with said path for the passage of the edge portions of said cans including induction elements flanking said way.

13. The invention according to claim 12 and means for rotating said cans while in said way.

* * * * *